US011293716B1

(12) United States Patent
Dahl

(10) Patent No.: US 11,293,716 B1
(45) Date of Patent: Apr. 5, 2022

(54) ARCHERY BOW AND SELECTIVELY REMOVABLE BLADED TOOL

(71) Applicant: William Dahl, Half Moon Bay, CA (US)

(72) Inventor: William Dahl, Half Moon Bay, CA (US)

(73) Assignee: William Dahl, Half Moon Bay, CA (US)

( * ) Notice: Subject to any disclaimer, the term of this patent is extended or adjusted under 35 U.S.C. 154(b) by 0 days.

(21) Appl. No.: 17/324,600

(22) Filed: May 19, 2021

(51) Int. Cl.
*F41B 5/14* (2006.01)
*B26B 3/00* (2006.01)
*F41B 5/10* (2006.01)

(52) U.S. Cl.
CPC ..... *F41B 5/1403* (2013.01); *B26B 3/00* (2013.01); *F41B 5/10* (2013.01); *F41B 5/1426* (2013.01)

(58) Field of Classification Search
CPC .. F41B 5/10; F41B 5/14; F41B 5/1426; F41B 5/148; F41B 5/00; F41B 5/1403; B26B 3/00
USPC ..... 124/25.6, 86, 88, 89
See application file for complete search history.

(56) References Cited

U.S. PATENT DOCUMENTS 4,387,697 A * 6/1983 Duke ..... B25B 27/02 124/89
4,633,846 A * 1/1987 Ipock ..... F41B 5/1426 124/23.1
4,907,567 A * 3/1990 Henrich ..... F41B 5/1426 124/23.1
4,955,356 A * 9/1990 Pike ..... F41B 5/1426 124/88
5,520,164 A * 5/1996 Huddleston ..... F41B 5/14 124/86
7,318,429 B2 * 1/2008 Achkar ..... F41B 5/14 124/86
8,281,773 B2 * 10/2012 Dahl, II ..... F41B 5/10 124/25.6
8,485,169 B2 * 7/2013 Dahl, II ..... F41B 5/0094 124/25.6
9,726,452 B1 * 8/2017 Pequeno-Gimenez ... F23Q 1/06

* cited by examiner

*Primary Examiner* — Alexander R Niconovich
(74) *Attorney, Agent, or Firm* — Klintworth & Rozenblat IP LLP

(57) ABSTRACT

An archery bow includes a riser body having a first end and a second end, a first bow limb connected to the first end of the riser body and a second bow limb connected to the second end of the riser body. The archery bow also includes a pulley arrangement supported on the first bow limb and the second bow limb, the pulley arrangement having a cam arrangement, and a cable arrangement interfaced with pulley arrangement, the cable arrangement operable for movement between an undrawn condition and a drawn condition. The archery bow further includes a bladed tool removably secured to the riser body, the bladed tool having a handle and a blade, and a bladed tool fastener configured to removably secure the bladed tool to the riser body. The bladed tool may function as a bow stabilizer.

19 Claims, 5 Drawing Sheets

ARCHERY BOW AND SELECTIVELY REMOVABLE BLADED TOOL

BACKGROUND

The following description relates generally to an archery bow having a selectively attachable and removable bladed tool.

Archery bows are commonly used for hunting and in competitive archery. In a conventional archery bow, a drawstring interacts with a series of cables, pulleys, cams and flexible limbs to accumulate and store energy in response to the drawstring being drawn in a rearward direction. An arrow is positioned relative to the drawstring such that releasing the drawstring transfers a portion of the accumulated, stored energy to the arrow to project the arrow from the bow. Examples of such bows are disclosed in U.S. Pat. Nos. 8,281,773 and 8,485,169, both of which are incorporated herein by reference in their entireties.

Various accessories may be added to archery bows, for example, to improve performance or comfort, or otherwise customize the bow for a particular user or application (e.g., a particular hunting application or a particular competition). One such accessory is a stabilizer. A stabilizer is provided in a predetermined shape, weight, and length, and is attached to a forward portion of the archery bow. Thus, the stabilizer extends forward from the archery bow and adds forward weight to the bow. In this manner, the stabilizer is configured to improve balance of the bow in a user's hand and dampen vibration of the bow.

However, the stabilizer may be bulky or cumbersome when transporting the archery bow. In addition, functionality of the stabilizer is primarily directed to the improved balance and vibration dampening aspects referred to above, during operation of the archery bow. However, the stabilizer may not provide additional functionality when transporting the archery bow.

Accordingly, it is desirable to provide an archery bow having a selectively removable and attachable bladed tool which may replace, or be used interchangeably with, a traditional archery bow stabilizer to provide auxiliary functionality.

SUMMARY

In one embodiment, an archery bow includes a riser body having a first end and a second end, a first bow limb connected to the first end of the riser body, a second bow limb connected to the second end of the riser body. A pulley arrangement is supported on the first bow limb and the second bow limb and includes a cam arrangement. A cable arrangement is interfaced with the pulley arrangement and is operable for movement between an undrawn condition and a drawn condition. A bladed tool is removably secured to the riser body and includes a handle and a blade. A bladed tool fastener is configured to removably secure the bladed tool to the riser body. In some embodiments, the blade may include a sharpened blade edge forming a cutting edge.

The riser body has a forward-facing surface and the bladed tool may be removably secured to the forward-facing surface. The bladed tool fastener may be a threaded fastener arrangement having a threaded male portion formed with one of the bladed tool and the riser body, and a corresponding threaded female portion formed with the other of the bladed tool and the riser body. The threaded female portion may be configured for mating, threaded engagement with the threaded male portion. The threaded male portion may be a threaded bolt formed on the bladed tool and the threaded female portion may be a threaded bore extending into the riser body. The threaded bolt may extend rearward from the handle and the threaded bore may extend into the riser body from the forward-facing surface. The bladed tool fastener may further include a thumb nut having an elongated portion and a threaded opening configured for mating engagement with the threaded male portion such that rotation of thumb nut relative to the threaded male portion causes the thumb nut to move along a length of the threaded male portion.

The first bow limb and the second bow limb may each be formed from resilient material and may each be configured to deflect in response to moving the cable arrangement to the drawn condition. The riser body may be formed of a rigid, stiff material configured to resist deflection in response to movement of the cable arrangement to the drawn condition and release of the cable arrangement to the undrawn condition.

The pulley arrangement may include an idler pulley rotatably coupled to the first bow limb and a power pulley rotatably coupled to the second bow limb. The first bow limb may further include a first yoke at a distal end and the idler pulley may be rotatably coupled to the first yoke with a first axle. The second bow limb may further include a second yoke at a distal end and the power pulley may be rotatably coupled to the second yoke with a second axle.

The cam arrangement may be formed on the power pulley and may include an outer cam lobe having an eccentric shape along an outer profile of the power pulley and an inner cam lobe axially offset from the outer cam lobe and at least partially within the outer profile.

The cable arrangement may include a power cable and a drawstring cable. The drawstring cable may be configured to be drawn rearward to move from an undrawn position to a drawn position corresponding to the undrawn condition and the drawn condition, respectively. The power cable may include a first cable end connected to the first bow limb and a second cable end anchored to and journaled for winding-up on the inner cam lobe in response to movement of the drawstring cable to the drawn position and unwinding from the inner cam lobe in response to movement of the drawstring cable to the undrawn position. The drawstring cable may include an outer end anchored to and journaled for unwinding from the outer cam lobe in response to movement of the drawstring cable to the drawn position and winding-up on the outer cam lobe in response to movement of the drawstring cable to the undrawn position, and an inner end anchored to and journaled for unwinding from the inner cam lobe in response to movement of the drawstring cable to the drawn position and winding-up on the inner cam lobe in response to movement of the drawstring cable to the undrawn position. The drawstring cable may be looped around the idler pulley such that an outer segment of the drawstring cable extends from the outer end at the outer cam lobe to the idler pulley and an inner segment of the drawstring cable extends from the idler pulley to the inner end at the inner cam lobe.

The archery bow may further include a cable guard rod extending rearward from the riser body and a cable glide configured for sliding movement on the cable guard rod. The power cable and the drawstring cable may be connected to the cable glide and may cause sliding movement of the cable glide in response to movement of the drawstring cable between the undrawn position and the drawn position.

In another embodiment, a bladed tool for an archery bow includes a handle configured to be grasped by a user, a blade connected to the handle, the blade having a sharpened blade edge to form a cutting edge, and a bladed tool fastener provided at a rear portion of the handle and configured to selectively engage the archery bow to removably secure the handle to the archery bow.

The bladed tool fastener may include a threaded male portion extending rearwardly from the handle and configured for mating engagement with a corresponding threaded female portion on the archery bow. The bladed tool fastener may also include a thumb nut having an elongated portion and a threaded opening, the threaded opening configured for mating engagement with the threaded male portion such rotation of the thumb nut about on the threaded male portion causes movement of the thumb nut along a length of the threaded male portion.

The blade may further include a base section configured for attachment to the handle. The base section may be fastened between oppositely positioned portions of the handle. The handle and the blade may be made from different materials.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
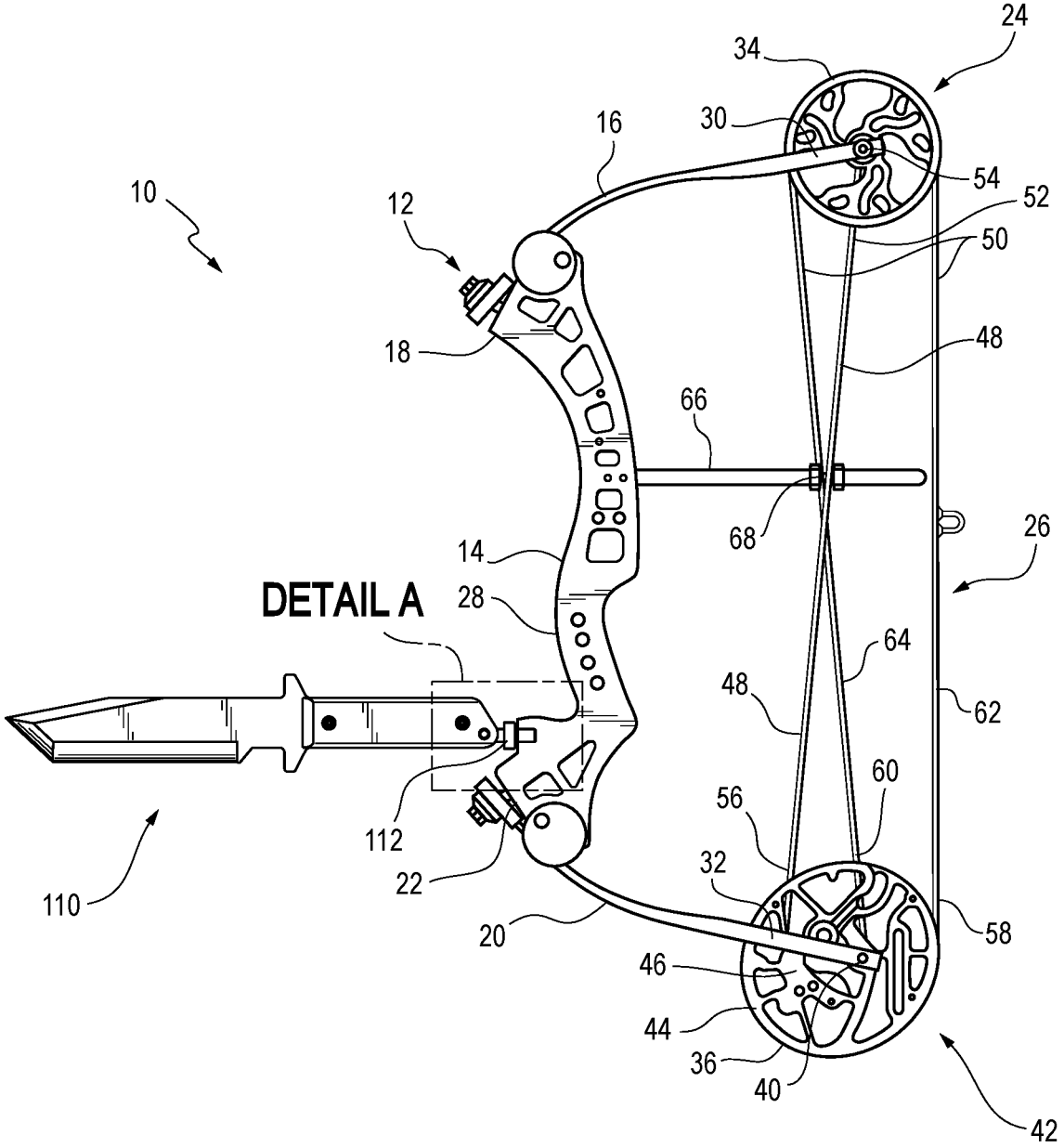
FIG. 1 is a side view of an archery bow having a bladed tool according to an embodiment.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Generally, the disclosure provides an archery bow having a selectively removable and attachable bladed tool. In some examples, the bladed tool may replace, or be used alternatively and interchangeably with a bow stabilizer. Accordingly, the bladed tool may be attached to the archery bow and extend forward (i.e., in the direction of an arrow projected from the bow) from the bow. The bladed tool may also be shaped, sized and weighted to provide stabilizer functionality, including balancing the archery bow in a user's hand and dampening vibration of the archery bow when the bow is operated. Thus, in some embodiments, the bladed tool may be a bow stabilizer (i.e., a bladed bow stabilizer).

The bladed tool includes a fastening arrangement configured to selectively engage the archery bow to releasably secure the bladed tool to the archery bow. In one example, the fastening arrangement of the bladed tool is configured to engage a complementary fastening arrangement of the archery bow to which a bow stabilizer may alternatively be secured. That is, the complementary fastening arrangement of the archery bow may be configured to engage the bladed tool, or alternatively, a bow stabilizer, such that one may be removed from the archery bow and replaced with the other. In another example, the fastening arrangement of the bladed tool may be independently secured to the archery bow (i.e., without a complementary fastening arrangement on the bow).

An archery bow equipped with the bladed tool according to the examples herein may provide auxiliary functionality relative to an archery bow equipped with a traditional stabilizer or no stabilizer at all. For example, as described above, the bladed tool may provide stabilizer functionality during operation of the archery bow to project an arrow toward a target. In addition, the bladed tool may be operated, for example, during transport of the archery bow, by controlling movements of the archery bow with the bladed tool attached. For example, in an outdoor or hunting application, a user may control movements of the archery bow to direct the bladed tool toward a target in close proximity to the user, where loading and using an arrow may not be practical or efficient. Further, the bladed tool may be operated by removing the bladed tool from the bow. In this manner, a user may quickly access and utilize the bladed tool for example, in a cutting application, without carrying excess or cumbersome equipment to store a separate tool, such as a holster, toolbox, storage case or the like.

In some examples, the bladed tool may be a bayonet. The bayonet may include a blade and a handle configured to be grasped by the user. The archery bow may be any suitable type of archery bow, such as a compound (vertical) bow or a cross-bow (horizontal). Thus, it will be appreciated that references to a particular archery bow type (e.g., a compound bow or a cross-bow) in the following examples and/or depictions of the particular archery bow type in the accompanying figures are made for illustrative purposes and are not limiting.

Referring generally to FIGS. 1-9, the present examples relate to an archery bow 10 having a removably attached bladed tool 110. The archery bow 10 includes a bow body 12 and the bladed tool 110 is removably attached to the bow body 12. In one example, the bow body 12 includes a riser body 14 and the bladed tool 110 is removably attached to the riser body 14. The bladed tool 110 may be removably attached to the bow body 12 with a bladed tool fastener 112. In some examples, the bladed tool fastener 112 is configured for selective engagement with a complementary fastener 116 on the bow body 12. The complementary fastener 112 may be arranged at forward-facing surface of the bow body 12 and the bladed tool 110 may be attached to the bow body 12 to extend forward relative to the bow body 12. In some examples, the bladed tool 110 is removably attached to the riser body 14.

Turning to the example in FIG. 1, the archery bow 10 may further include a first bow limb 18 secured to a first end 18 of the riser body 14, a second bow limb 20 secured to a second end 22 of the riser body 14, a pulley arrangement 24 supported on the first and second bow limbs 16, 20 and a cable arrangement 26 interfaced with the pulley arrangement 24. In the example of a compound bow, the first and second bow limbs 16, 20 may be referred to as upper and lower bow limbs, respectively. The archery bow 10 may be operated from an initial or undrawn condition to a loaded or drawn condition. The archery bow 10 may also be released from the loaded or drawn condition to return to the initial or undrawn condition. The archery bow 10 is configured to project an arrow in response to moving from the loaded or drawn condition to the initial or undrawn condition by transferring stored or accumulated energy to the arrow through such movement.

The riser body 14 is a substantially rigid support member having stiffness sufficient to resist deformations or deflections in response to various forces encountered during regular use of the archery bow 10. In a compound bow, the riser body 14 extends generally in a vertical direction during use. In some examples, the riser body 14 may be formed with various contours such as concave and convex portions. The riser body 14 includes a forward-facing surface 28 generally facing a direction in which an arrow is projected from the archery bow 10. When vertically oriented, for example in a compound bow, the riser body 14 also includes lateral surfaces facing in generally opposite lateral directions (i.e., substantially perpendicular to a direction in which the arrow is projected from the bow) and a rearward-facing surface generally facing in a direction opposite to the forward-facing surface 28.

The first bow limb 16 may be made from a resilient material so as to elastically deflect when moving the archery bow 10 to the drawn condition and return to a released condition when the archery bow 10 is moved to the undrawn condition. The first bow limb 16, at a proximal end, is secured to the first end 18 of the riser body 14 with a known, suitable bow limb fastening arrangement. Such a fastening arrangement may include a threaded bolt configured for mating engagement with a threaded bore in the riser body 14, and the threaded bolt may be received through an opening or slot of the first bow limb 16 to secure the first bow limb 16 between a portion of the threaded bolt (e.g., a bolt head) and the riser body 14. The first bow limb 16 extends generally rearward relative to the riser body 14 and includes a first yoke 30 at a distal end.

The second bow limb 20 may be made from a resilient material so as to elastically deflect when moving the archery bow 10 to the drawn condition and return to a released condition when the archery bow 10 is moved to the undrawn condition. The second bow limb 20, at a proximal end, is secured to the second end 22 of the riser body 14 with the known, suitable bow limb fastening arrangement. For example, a threaded bolt may be received through an opening or slot of the second bow limb 20 and received in a corresponding threaded bore of the riser body 14 to secure the second bow limb 20 between a portion of the threaded bolt (e.g., a bolt head) and the riser body 14. The second bow limb 20 extends generally rearward relative to the riser body 14 and includes a second yoke 32 at a distal end.

The pulley arrangement 24 is supported on the first and second bow limbs 16, 20 and is configured to accommodate movement of the archery bow 10 between the undrawn condition and the drawn condition by operation of the cable arrangement 26. In one example, the pulley arrangement 24 includes an idler pulley 34 and a power pulley 36. The idler pulley 34 is rotatably coupled to the first yoke 30, for example, by a first axle 38. The power pulley 36 is rotatably coupled to the second yoke 32, for example, by a second axle 40.

Figure 2:
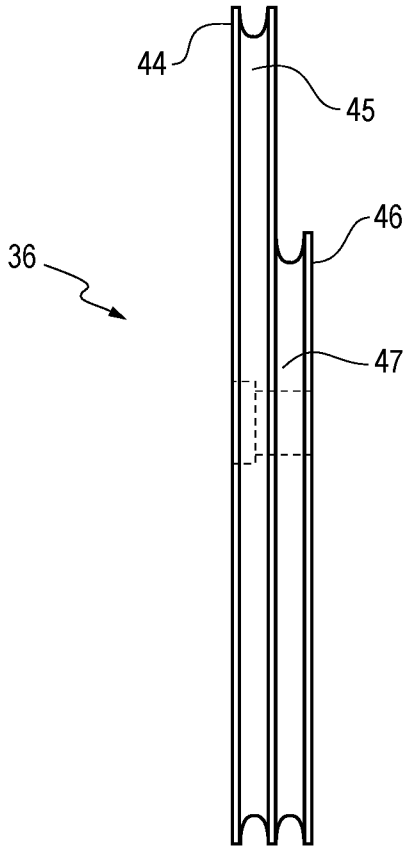
FIG. 2 is a view illustrating an example of a power pulley of the archery bow of FIG. 1.

With reference to FIGS. 1 and 2, in one example, the idler pulley 34 may be implemented as a wheel having a substantially circular shape (i.e., a circular outer profile or circumference), and the power pulley 36 may be implemented as an eccentrically shaped cam pulley (i.e., a pulley having an eccentric outer profile) having a cam arrangement 42. In one example, the cam arrangement 42 may include an outer cam lobe 44 formed by and arranged along an outer profile of the power pulley 36 and an inner cam lobe 46 offset axially relative to the outer cam lobe 44 and arranged at least partially within the outer profile of the power pulley 36 in an axial view. The outer cam lobe 44 may include an outer cam race 45 configured to receive a portion of the cable arrangement 26 and the inner cam lobe 46 may include an inner cam race 47 configured to receive another portion of the cable arrangement 26.

It will be appreciated that the present disclosure is not limited to the example of the pulley arrangement 24 described above. For example, in other embodiments, the idler pulley 34 may be implemented as part of the cam arrangement and may be eccentrically shaped to function as a cam element.

The cable arrangement 26 is coupled to the pulley arrangement 24 and is operable for movement between an undrawn condition and a drawn condition, corresponding to the undrawn condition and the drawn condition of the archery bow 10, respectively. For example, a generally rearward directed force may be applied to a portion of the cable arrangement 26 to move the cable arrangement 26 from the undrawn condition to the drawn condition. The cable arrangement 26 may be released (e.g., by releasing the rearward force) to return to the undrawn condition under a biasing force. In one example, the cable arrangement 26 may have a first tension in the undrawn condition and a second tension in the drawn condition, greater than the first tension to urge the cable arrangement 26 from the drawn condition to the undrawn condition. In addition, the deflected, or flexed, first and second bow limbs 16, 20 urge the cable arrangement 26 from the drawn condition to the undrawn condition.

In one example, the cable arrangement 26 includes a power cable 48 and a drawstring cable 50. The cables 48, 50 may be made from known suitable materials, including metal materials such as steel, a synthetic material or materials, or a natural material. The power cable 48 includes a first cable end 52 having one or more attachment loops 54 for connecting the power cable 48 to the first bow limb 16, for example, via the first axle 38 or the idler pulley 34. The power cable 48 also includes a second cable end 56 connected to the power pulley 36. In one example, the second cable end 56 of the power cable 48 is anchored to and journaled for winding-up around the inner cam race 47 of the inner cam lobe 46 in response to movement to the drawn condition. Conversely, the second cable end 56 is configured to unwind from the inner cam lobe 46 in response to movement to the undrawn condition.

The drawstring cable 50 generally includes an outer end 58 anchored to and journaled for unwinding from the outer cam race 45 of the outer cam lobe 44 in response to movement to the drawn condition. Conversely, the outer end 58 is configured for winding-up on the outer cam lobe 44 in response to movement to the undrawn condition. The drawstring cable 50 also includes an inner end 60 anchored to and journaled for unwinding from the inner cam race 47 of the inner cam lobe 46 in response to movement to the drawn condition. Conversely, the inner end 60 is configured for winding-up on the inner cam lobe 46 in response to movement to the undrawn condition.

The drawstring cable 50 extends from the outer end 58 at the outer cam lobe 44 to the idler pulley 34, forming an outer cable segment 62. The drawstring cable 50 loops around the idler pulley 34 in an idler race (not shown) and extends to the inner end 60 at the inner cam lobe 46, forming an inner cable segment 64.

The outer cable segment 62 is generally disposed at a rearward portion of the archery bow 10 and is configured to be drawn rearward relative to the riser body 14 by application of an external force (e.g., by a user) to move to a drawn position corresponding to the drawn condition of the cable arrangement 26 and the archery bow 10. Drawing the outer cable segment 62 rearward causes the outer end 58 to unwind from the outer cam race 45 of the outer cam lobe 44 and the inner end 60 to unwind from the inner cam race 47 of the inner cam lobe 46. In addition, the second cable end 56 of the power cable 48 winds up on the inner cam race 47 of the inner cam lobe 46, which causes at least one of the first bow limb 16 and the second bow limb 20 to deflect toward the other. That is, when the archery bow 10 is moved to the drawn condition, the power cable 48 and the drawstring cable 50 are tensioned (or are subjected to an increase in tension relative to the initial or undrawn condition), and one or more of the first and second bow limbs 16, 20 are deflected against a biasing or spring force such that the one or more first and second bow limbs 16, 20 store potential energy. The biasing or spring force may be provided by the elasticity of the material from which the bow limbs 16, 20 are formed. The stored energy in the first and/or second bow limbs 16, 20, as well as in the tension of the power cable 48 and drawstring cable 50, urge the archery bow 10 (and cable arrangement 26) to return to the undrawn condition and the drawstring cable 50 (e.g., at the outer cable segment 62) to return to an undrawn position corresponding to the undrawn condition. Thus, in the drawn condition, the drawstring cable 50, at the outer cable segment 62, may be released and the archery bow 10 and cable arrangement 26 may return to the undrawn condition causing the arrow to be projected from the archery bow 10.

The bow body 12 may further include a cable guard rod 66 connected to and extending rearward from the riser body 14. A cable glide 68 is disposed on the cable guard rod 66 and is configured for sliding movement along the cable guard rod 66. The power cable 48 and the drawstring cable 50 are connected to the cable glide 68 and cause the cable glide 68 to slide along the cable guard rod 66 when moving between the undrawn condition and the drawn condition.

While examples of the pulley arrangement, cam arrangement and cable arrangement are provided above, it will be appreciated that the present disclosure is not limited to these examples. For example, it is envisioned that in other embodiments, the archery bow 10 may include any conventional pulley arrangement, cam arrangement and/or cable arrangement suitable for use in an archery bow, such as a compound bow.

Figure 3:
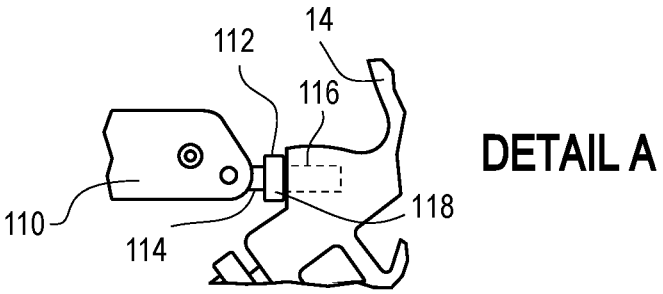
FIG. 3 is an enlarged view showing DETAIL A of FIG. 1.
Figure 4:
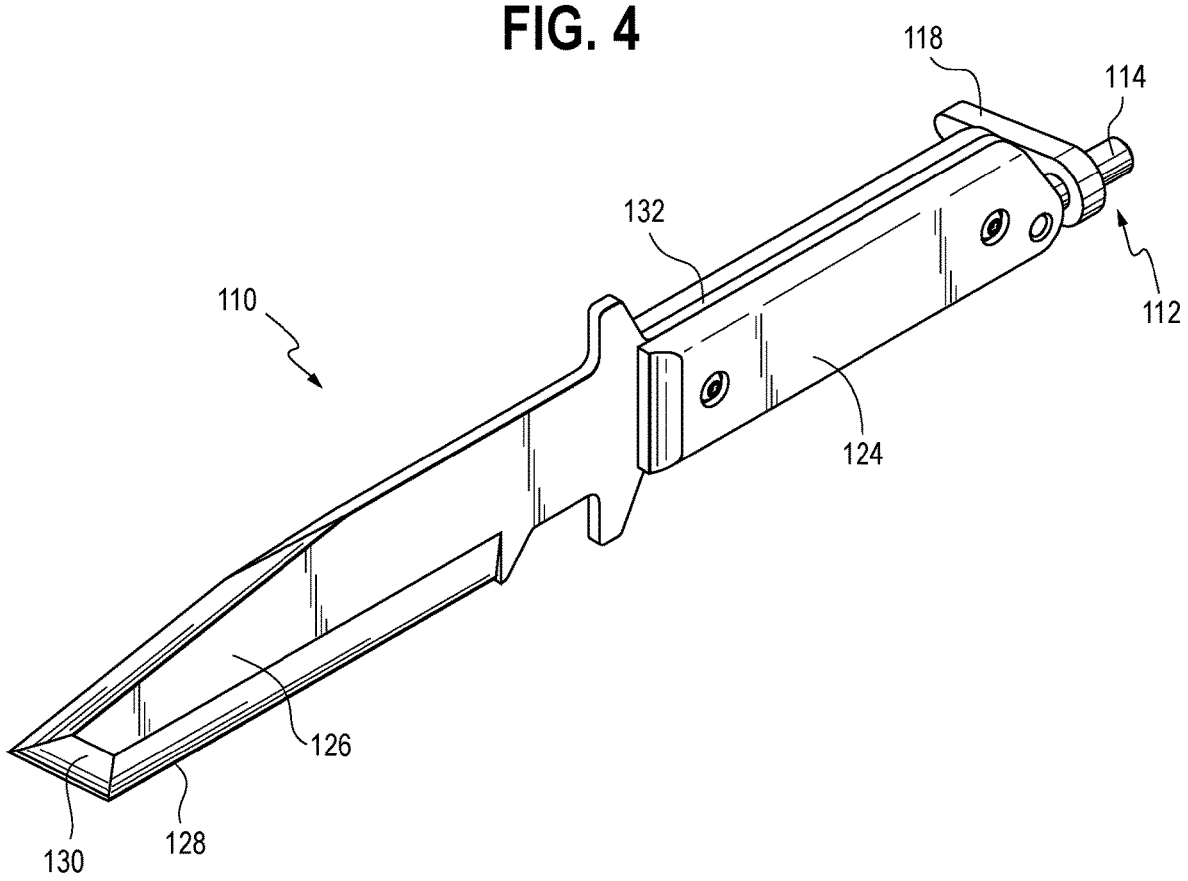
FIG. 4 is a perspective view of the bladed tool of FIG. 1.
Figure 5:
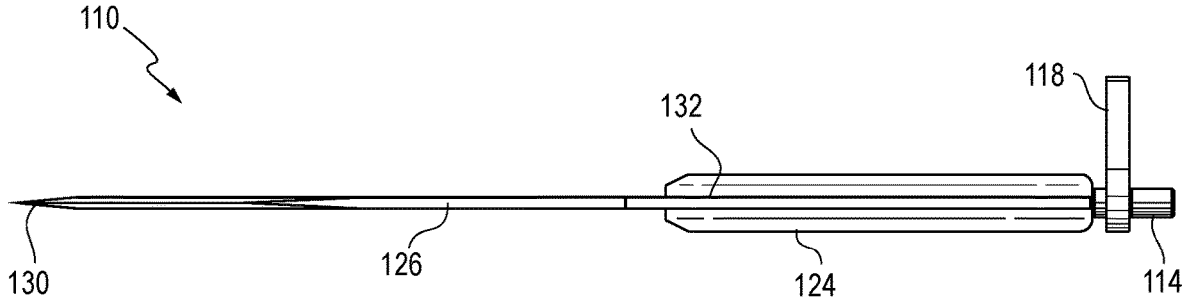
FIG. 5 is a top view of the bladed tool of FIG. 1.
Figure 6:
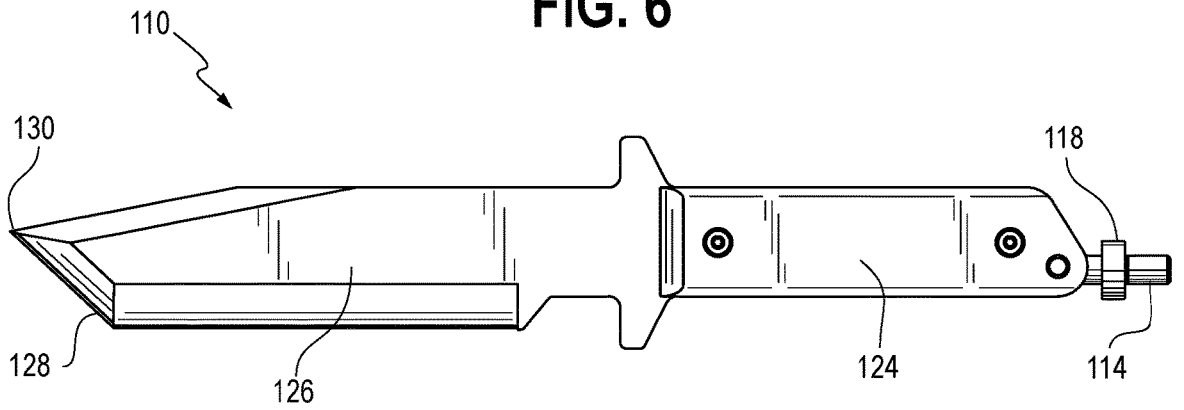
FIG. 6 is side view of the bladed tool of FIG. 1.
Figure 7:
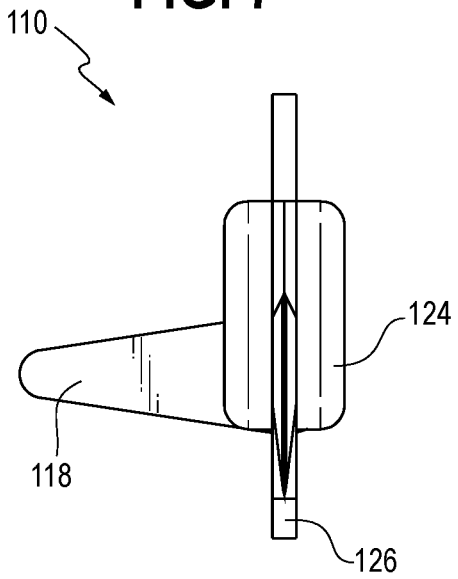
FIG. 7 is a front view of the bladed tool of FIG. 1.
Figure 8:
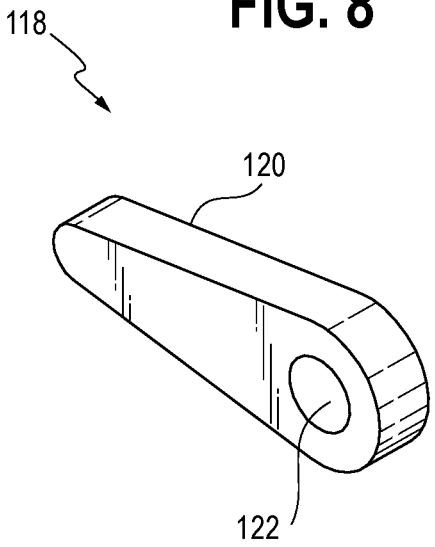
FIG. 8 is an isolated perspective view showing a portion of a bladed tool fastener according to an embodiment.
Figure 9:
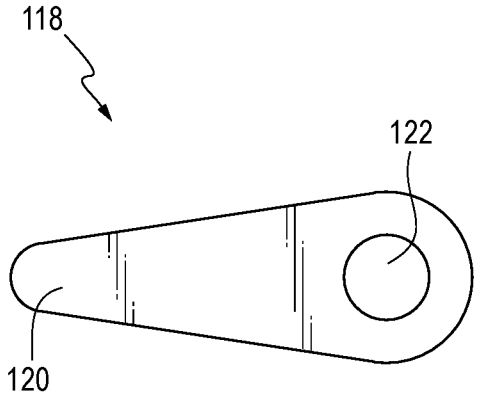
FIG. 9 is a front view of the bladed tool fastener of FIG. 7.

Referring now to FIGS. 1 and 3, the bladed tool 110 is removably secured to bow body 12, for example, at the forward-facing surface 28 of the riser body 14, with a bladed tool fastener 112. The bladed tool fastener 112 may be provided at a rear portion of the bladed tool 110 and is configured to selectively engage the bow body 12 to removable secure the bladed tool 110 to bow body 12. In one example, the bladed tool fastener 112 may be a threaded fastener arrangement having a threaded male portion 114, such as a threaded bolt, and a threaded female portion 116, such as a threaded bore, configured for mating threaded engagement with the threaded male portion 114. The threaded male portion 114 may be provided on one of the bladed tool 110 and the riser body 14 and the female portion 116 may be provided on the other of the bladed tool 110 and the riser body 14. Thus, the bladed tool 110 may be attached to the bow body 12 by way of the mating threaded engagement between the threaded male portion 114 and the threaded female portion 116. It will be appreciated that the bladed tool fastener 112 may be implemented as other suitable fasteners as well. For example, the bladed tool fastener 112 may include a male portion configured for friction fit with a female portion, mating interlocking components (e.g., a dovetail arrangement), clevis pins and the like. Another suitable fastener which may implemented at least part as the bladed tool fastener 112 is a clamp.

With reference to FIGS. 1 and 3-9, in one embodiment, the bladed tool fastener 112 may further include a thumb nut 118 configured to secure the bladed tool 110 to the bow body 12. As shown, for example, in FIGS. 8 and 9, the thumb nut 118 includes an elongated portion 120 and a threaded opening 122. The thumb nut 118 is configured for threaded engagement with the threaded male portion 114 via the threaded opening 122. The thumb nut 118 is configured for axial movement along the threaded male portion 114 by way of rotation on the threaded male portion 114 and engagement of the corresponding threads. In this manner, the thumb nut 118 may be moved along the threaded male portion 114 to a position adjacent to the threaded female portion 116. For example, the thumb nut 118 may be moved into abutting contact with the forward-facing surface 28 of the riser body 14, adjacent to the threaded female portion 116 to bring the corresponding threads of the male portion 114 and the female portion 116 into tight contact. In this manner, the thumb nut 118 may secure the bladed tool 110 against unintentional or inadvertent removal from the riser body 14. The thumb nut 118 may be manipulated by a user, for example, by grasping the elongated portion 120 and rotating on the threaded male portion 114.

Referring now to FIGS. 4-9, in one embodiment, the bladed tool 110 further includes a handle 124 and a blade 126. The blade 126 includes a blade edge 128 which may be sharpened for use as a cutting edge. The blade 126 may further have a blade point 130 at a distal end (i.e., a forward-most, leading end). The blade 126 may also have a base section 132 configured for attachment to the handle 124. For example, the base section 132 may be fastened between oppositely positioned handle portions with a suitable fastener. The handle 124 may be configured for gripping by a hand. For example, the handle 124 may be shaped and sized to fit in the user's palm and to be grasped by the user. The handle 124 may include various contours to provide a comfortable, ergonomic grip, and/or to assist in the user's ability to grip or maintain a grip on the handle 124. In one example, the handle 124 and the blade 126 are made from different materials. For example, the handle 124 may be made from a hard plastic material and the blade 126 may be made from a metal or composite material.

In use, the bladed tool 110 may be removably attached to the riser body 14 by inserting the threaded male portion 114 of the bladed tool fastener 112 into the threaded female portion 116 for threaded engagement. The thumb nut 118 may be moved along the threaded male portion 114 and into contact with the riser body 14 to secure the bladed tool 110 to the riser body 14. For example, the thumb nut 118 may be tightened against the riser body 14 to reduce vibration and resist unintentional removal of the bladed tool 110. Conversely, the bladed tool 110 may be removed from the riser body 14 by moving the thumb nut 118 away from the riser body 14 along the threaded male portion 114 and rotating the bladed tool 110 relative to the riser body 14 to disengage the corresponding threads.

Accordingly, in the embodiments above, an archery bow 10 is provided having a selectively removable bladed tool 110 extending from a forward-facing surface 28 of the riser body 14. The user may effect movements of the bladed tool 110 for certain applications by maneuvering the bow body 12. The bladed tool 110 is also easily accessible by the user and may be quickly and easily removed from and secured to the bow body 12. The bladed tool 110 may also provide stabilizer functionality during operation of the bow 10. In addition, the user may carry the bladed tool 110 without carrying additional storage equipment (e.g., holster, case, etc.) may quickly alternate between using the archery bow 10 to project an arrow and using the bladed tool 110. The archery bow may, for example, be a compound bow or a cross-bow.

It is understood that the relative directions described above, e.g, "upward," "downward," "upper," "lower," "above," "below," are used for illustrative purposes only and may change depending on an orientation of a component. Accordingly, this terminology is non-limiting in nature. In addition, it is understood that one or more various features of an embodiment above may be used in, combined with, or replace other features of a different embodiment described herein.

All patents referred to herein, are hereby incorporated herein in their entirety, by reference, whether or not specifically indicated as such within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

The invention claimed is:

1. An archery bow comprising:

a riser body having a first end and a second end;

a first bow limb connected to the first end of the riser body;

a second bow limb connected to the second end of the riser body;

a pulley arrangement supported on the first bow limb and the second bow limb, the pulley arrangement comprising a cam arrangement;

a cable arrangement interfaced with pulley arrangement, the cable arrangement operable for movement between an undrawn condition and a drawn condition;

a bladed tool removably secured to the riser body, the bladed tool comprising a handle and a blade; and a bladed tool fastener arranged at a rear portion of the handle configured to selectively engage a complementary fastener on the riser body to removably secure the bladed tool to the riser body, wherein, with the bladed tool secured to the riser body, the bladed tool fastener is engaged with the complementary fastener, the rear portion of the handle is adjacent to a forward-facing surface of the riser body, the handle extends forward relative to the riser body, and the blade extends forward relative to the handle, such that the blade is spaced from the riser body by the handle and a cutting edge of the blade is exposed.

2. The archery bow of claim 1, wherein the bladed tool is removably secured to the forward-facing surface of the riser body.

3. The archery bow of claim 1, wherein the bladed tool fastener is a threaded fastener arrangement comprising a threaded male portion formed with one of the bladed tool and the riser body, and a corresponding threaded female portion formed with the other of the bladed tool and the riser body, wherein the threaded female portion is configured for mating, threaded engagement with the threaded male portion.

4. The archery bow of claim 3, wherein the threaded male portion is a threaded bolt formed on the bladed tool and the threaded female portion is a threaded bore extending into the riser body.

5. The archery bow of claim 4, wherein the threaded bolt extends rearward from the rear portion of the handle and the threaded bore extends into the riser body from the forward-facing surface.

6. The archery bow of claim 3, wherein the bladed tool fastener further comprises a thumb nut having an elongated portion and a threaded opening configured for mating engagement with the threaded male portion such that rotation of thumb nut relative to the threaded male portion causes the thumb nut to move along a length of the threaded male portion.

7. The archery bow of claim 1, wherein the first bow limb and the second bow limb are each formed from resilient material and are configured to deflect in response to moving the cable arrangement to the drawn condition.

8. The archery bow of claim 1, wherein the riser body is formed of a rigid, stiff material configured to resist deflection in response to movement of the cable arrangement to the drawn condition and release of the cable arrangement to the undrawn condition.

9. The archery bow of claim 1, wherein the pulley arrangement comprises an idler pulley rotatably coupled to the first bow limb and a power pulley rotatably coupled to the second bow limb.

10. The archery bow of claim 9, wherein the first bow limb further comprises a first yoke at a distal end and the idler pulley is rotatably coupled to the first yoke with a first axle, and the second bow limb further comprises a second yoke at a distal end and the power pulley is rotatably coupled to the second yoke with a second axle.

11. The archery bow of claim 9, wherein the cam arrangement is formed on the power pulley and comprises an outer cam lobe having an eccentric shape along an outer profile of the power pulley and an inner cam lobe axially offset from the outer cam lobe and at least partially within the outer profile.

12. The archery bow of claim 11, wherein the cable arrangement comprises a power cable and a drawstring cable, wherein the drawstring cable is configured to be drawn rearward to move from an undrawn position to a drawn position corresponding to the undrawn condition and the drawn condition, respectively.

13. The archery bow of claim 12, wherein:

the power cable includes a first cable end connected to the first bow limb and a second cable end anchored to and journaled for winding-up on the inner cam lobe in response to movement of the drawstring cable to the drawn position and unwinding from the inner cam lobe in response to movement of the drawstring cable to the undrawn position; and the drawstring cable includes an outer end anchored to and journaled for unwinding from the outer cam lobe in response to movement of the drawstring cable to the drawn position and winding-up on the outer cam lobe in response to movement of the drawstring cable to the undrawn position, and an inner end anchored to and journaled for unwinding from the inner cam lobe in response to movement of the drawstring cable to the drawn position and winding-up on the inner cam lobe in response to movement of the drawstring cable to the undrawn position, wherein the drawstring cable is looped around the idler pulley such that an outer segment of the drawstring cable extends from the outer end at the outer cam lobe to the idler pulley and an inner segment of the drawstring cable extends from the idler pulley to the inner end at the inner cam lobe.

14. The archery bow of claim 13, further comprising a cable guard rod extending rearward from the riser body and a cable glide configured for sliding movement on the cable guard rod, wherein the power cable and the drawstring cable are connected to the cable glide and cause sliding movement of the cable glide in response to movement of the drawstring cable between the undrawn position and the drawn position.

15. A bladed tool for an archery bow, the bladed tool comprising:

a handle configured to be grasped by a user;

a blade connected to the handle, the blade having a sharpened blade edge to form a cutting edge; and a bladed tool fastener provided at a rear portion of the handle and configured to selectively engage the archery bow to removably secure the handle to the archery bow, wherein the blade extends forward from a forward portion of the handle such that the handle is arranged between the bladed tool fastener and the blade along a length of the bladed tool.

16. The bladed tool of claim 15, wherein the bladed tool fastener comprises:

a threaded male portion extending rearwardly from the rear portion of the handle and configured for mating engagement with a corresponding threaded female portion on the archery bow; and a thumb nut having an elongated portion and a threaded opening, the threaded opening configured for mating engagement with the threaded male portion such that rotation of the thumb nut about the threaded male portion causes the movement of the thumb nut along a length of the threaded male portion.

17. The bladed tool of claim 15, wherein the blade further comprises a base section configured for attachment to the handle.

18. The bladed tool of claim 17, wherein the base section is fastened between oppositely positioned portions of the handle.

19. The bladed tool of claim 15, wherein the handle and the blade are made from different materials.

* * * * *